US006322665B1

(12) United States Patent
Sun et al.

(10) Patent No.: US 6,322,665 B1
(45) Date of Patent: Nov. 27, 2001

(54) REACTIVE COMPOUNDS TO FIBROUS WEBS

(75) Inventors: Tong Sun, Neenah; Jeffrey D. Lindsay, Appleton, both of WI (US)

(73) Assignee: Kimberly-Clark Corporation, Neenah, WI (US)

( * ) Notice: Subject to any disclaimer, the term of this patent is extended or adjusted under 35 U.S.C. 154(b) by 0 days.

(21) Appl. No.: 09/426,300

(22) Filed: Oct. 25, 1999

(51) Int. Cl.[7] ..... D21F 11/00

(52) U.S. Cl. ..... 162/158; 162/168.1; 162/185; 162/169; 162/111; 162/9; 162/17; 162/19; 162/100; 162/157.6; 8/116.1; 8/185; 524/13; 524/35

(58) Field of Search ..... 162/9, 17, 19, 162/100, 157.6, 158, 168.1, 111, 185, 169; 8/116.1, 185; 524/13, 35

(56) References Cited

U.S. PATENT DOCUMENTS

| | | | | |
|---|---|---|---|---|
| 835,579 | | 11/1906 | Taylor . | |
| 1,260,570 | | 3/1918 | Pease . | |
| 2,083,423 | | 6/1937 | Bennett, Jr. . | |
| 2,161,805 | | 6/1939 | Dreyfus et al. . | |
| 2,277,426 | | 3/1942 | Wolf et al. . | |
| 2,415,564 | | 2/1947 | Radford et al. . | |
| 2,931,749 | | 4/1960 | Kine et al. . | |
| 3,015,584 | | 1/1962 | Reinhardt et al. . | |
| 3,395,708 | * | 8/1968 | Hervey | 128/284 |
| 3,483,024 | | 12/1969 | Roff, Jr. et al. . | |
| 3,532,534 | | 10/1970 | Wolff . | |
| 3,574,620 | | 4/1971 | Tesoro . | |
| 3,652,212 | | 3/1972 | Machell . | |
| 3,671,184 | | 6/1972 | Cuculo . | |
| 3,775,379 | | 11/1973 | Hausslein et al. . | |
| 3,798,120 | | 3/1974 | Enloe et al. . | |
| 3,844,880 | * | 10/1974 | Meisel | 162/169 |
| 3,846,155 | | 11/1974 | Wagner . | |
| 3,853,604 | | 12/1974 | Fleissner . | |
| 4,080,480 | | 3/1978 | Reinhardt et al. . | |
| 4,117,187 | | 9/1978 | Adams et al. . | |
| 4,144,120 | | 3/1979 | Eldin et al. . | |
| 4,204,054 | | 5/1980 | Lesas et al. . | |
| 4,210,489 | | 7/1980 | Markofsky . | |
| 4,216,591 | | 8/1980 | Bubley . | |
| 4,242,408 | | 12/1980 | Evani . | |
| 4,279,964 | | 7/1981 | Heller . | |
| 4,312,914 | | 1/1982 | Guth . | |
| 4,328,284 | | 5/1982 | LePoutre . | |
| 4,336,279 | | 6/1982 | Metzger . | |
| 4,423,194 | | 12/1983 | Lobach et al. . | |
| 4,454,279 | | 6/1984 | Ong et al. . | |
| 4,795,530 | * | 1/1989 | Soerens | 162/111 |
| 4,820,307 | | 4/1989 | Welch et al. . | |
| 4,828,650 | | 5/1989 | Wagle et al. . | |
| 4,842,893 | | 6/1989 | Vializis et al. . | |
| 4,888,093 | | 12/1989 | Dean et al. . | |
| 4,889,596 | | 12/1989 | Schoggen et al. . | |
| 5,032,461 | | 7/1991 | Shaw et al. . | |
| 5,042,986 | | 8/1991 | Kitchens et al. . | |
| 5,137,537 | | 8/1992 | Herron et al. . | |
| 5,147,345 | | 9/1992 | Young et al. . | |
| 5,190,563 | | 3/1993 | Herron et al. . | |
| 5,200,036 | | 4/1993 | Noda . | |
| 5,217,445 | | 6/1993 | Young et al. . | |
| 5,324,575 | | 6/1994 | Sultze et al. . | |
| 5,360,420 | | 11/1994 | Cook et al. . | |
| 5,437,418 | | 8/1995 | Graef et al. . | |
| 5,447,977 | | 9/1995 | Hansen et al. . | |
| 5,466,318 | | 11/1995 | Bjork . | |
| 5,549,791 | | 8/1996 | Herron et al. . | |
| 5,562,740 | | 10/1996 | Cook et al. . | |

(List continued on next page.)

FOREIGN PATENT DOCUMENTS

| | | |
|---|---|---|
| 818612 | 7/1969 | (CA) . |
| 1195049 | 10/1985 | (CA) . |
| 2727756 | 12/1977 | (DE) . |
| 2936239 | 3/1981 | (DE) . |
| 0828890 | 12/1996 | (EP) . |
| 0 899 377 | 3/1999 | (EP) . |
| 1568747 | 6/1980 | (GB) . |
| 50-05610 | 1/1975 | (JP) . |
| 56-155203 | 12/1981 | (JP) . |
| 62-1950023 | 8/1987 | (JP) . |
| WO 96 12615 | 5/1996 | (WO) . |
| WO 97 08384 | 3/1997 | (WO) . |
| WO 98/30387 | 7/1998 | (WO) . |
| WO 99/31312 | 6/1999 | (WO) . |

OTHER PUBLICATIONS

Ivanova et al., Use of Synthetic Polyesters in Paper Manufacture, Tselul, Khartiya 21, No. 2: 14–15 (1991).

Nguyen, C. C. H., ^Grafting Furfuryl Alcohol and Polyfurfuryl Alcohol to Cellulose and Lignocellulose Fibers, Dissertation Abstract 50, No. 10: 4564B (Apr. 1990).

Caufield, Daniel F., Ester crosslinking to improve wet performance of paper using multifunctional carboxylic acids, butanetetracarboxylic and citric acid, Tappi J., vol. 77, No. 3, pp. 205–212 (Mar. 1994).

Horie, Daisuke, et al., Application of durable–press treatment to bleached softwoodkdraft handsheets, Tappi J., vol. 77, No. 8, pp. 135–139 (Aug. 1994).

Yufeng Xu et al., Wet reinforcement of paper with high –molecular–weight multifunctional carboxylic acid, Tappi J., vol. 82, No. 8, pp. 150–156 (Aug. 1999).

Yufeng Xu et al., Application of polymeric multifunctional carboxylic acids to improve wet strength, Tappi J., vol. 81, No. 11, pp. 159–164 (Nov. 1998).

*Primary Examiner*—Stanley S. Silverman
*Assistant Examiner*—Mark Halpern
(74) *Attorney, Agent, or Firm*—Kilpatrick Stockton LLP

(57) ABSTRACT

Methods for making high wet performance webs. A polymeric anionic reactive compound is applied heterogenously to a cellulosic fibrous web followed by curing of the compound to crosslink the cellulose fibers. The resulting tissue has high wet resiliency, high wet strength, and a high wet:dry tensile strength ratio.

11 Claims, 2 Drawing Sheets

U.S. PATENT DOCUMENTS

| | | | | |
|---|---|---|---|---|
| 5,656,132 | | 8/1997 | Farrington, Jr. et al. . | |
| 5,718,728 | | 2/1998 | Arkens et al. . | |
| 5,755,828 | * | 5/1998 | Westland | 8/185 |
| 5,840,787 | | 11/1998 | West et al. . | |
| 5,858,021 | | 1/1999 | Sun et al. . | |
| 5,935,383 | | 8/1999 | Sun et al. . | |
| 5,938,995 | | 8/1999 | Koltisko, Jr. et al. . | |
| 5,958,180 | | 9/1999 | Hubbe et al. . | |
| 5,972,805 | | 10/1999 | Pomplun et al. . | |
| 5,998,511 | | 12/1999 | Westland et al. . | |
| 6,022,449 | | 2/2000 | Jansen et al. . | |
| 6,184,271 | | 2/2001 | Westland et al. . | |

* cited by examiner

REACTIVE COMPOUNDS TO FIBROUS WEBS

TECHNICAL FIELD

The invention relates to methods for making high wet performance webs.

BACKGROUND OF THE INVENTION

Webs having a high strength when they become wet (known in the art as wet strength) are useful for many applications. One application for such webs is as premoistened tissues, often used by travelers for cleansing the body. Such webs or tissues must maintain sufficient strength when stored in wet conditions for an extended period of time to withstand wiping and rubbing actions. Other applications for high wet strength webs is in articles that need to maintain integrity when wetted with body fluids, such as urine, blood, mucus, menses and other body exudates.

In the art of papermaking, chemical materials exist for improving the wet strength of paper. These materials are known in the art as "wet strength agents" and are commercially available from a wide variety of sources. For example, a polyamide/polyamine/epichlorohydrin resin is often used to enhance the wet strength of paper. This cationic resin is typically added to the papermaking slurry whereupon it bonds to the anionically charged cellulose. During the papermaking process the resin crosslinks and eventually becomes insoluble in water. The agent thus acts as a "glue" to hold the paper fibers together and enhances the wet strength of the paper. However, one needs to use chlorine in order to remove the resin and recycle products containing this resin, which presents environmental problems.

Cationic resins have other disadvantages, such as reacting with other anionic additives which it may be advantageous to add to the paper and, in many cases, increasing the dry strength of the paper as well, resulting in a less soft paper. Moreover, the effectiveness of cationic wet strength agents can be limited by low retention of the agent on the cellulose fiber.

The use of formaldehyde and various formaldehyde addition products to crosslink cellulosic fibers is known in the art. However, formaldehyde is an irritant and a known carcinogen. Crosslinking with compounds comprising formaldehyde at elevated temperatures can be particularly rapid relative to many other crosslinkers, requiring times as low as 1 to 10 seconds. However, for higher molecular weight compounds and for formaldehyde-free crosslinkers in general, much longer reaction times are found.

Other references disclose absorbent structures containing individualized, crosslinked fibers, wherein the crosslinking agent is selected from the group consisting of $C_2$ to $C_8$ dialdehydes, with glutaraldehyde being desired. The cost associated with producing fibers crosslinked with dialdehyde crosslinking agents such as glutaraldehyde may be too high to result in significant commercial success.

The use of monomeric polycarboxylic acids to impart wrinkle resistance to cotton fabrics is known. A cellulosic material was impregnated with a solution of the polycarboxylic acid and a catalyst, followed by drying the material and then curing the material in an oven at 150° C. to 240° C. for 5 seconds to 30 minutes.

The prior art also teaches a method of imparting wrinkle resistance to cellulosic textiles by crosslinking monomeric cyclic aliphatic hydrocarbons having multi carboxylic acid groups to the cellulose. Curing is said to be performed at about 150° C. to 240° C. for 5 seconds to 30 minutes.

The use of $C_2$ to $C_9$ monomeric polycarboxylic acids to make individualized, crosslinked cellulosic fibers having primarily intra-fiber crosslinking (crosslinks between cellulose units in a single fiber) and purportedly having increased absorbency has been taught.

Polyacrylic acid has been taught as a crosslinking agent, preferably as a copolymer with polymaleic acid. The fibers were fiberized prior to curing to make individualized, crosslinked cellulosic fibers having primarily intra-fiber crosslinking. The fibers are purportedly useful in absorbents. The crosslinking was achieved using temperatures of about 120° C. to 160° C.

Various resinous maleic anhydride compositions have been used in conjunction with paper products. For example, prior art discloses paper products coated with a composition including an amine salt of a low molecular weight $C_6$ to $C_{24}$ olefin/maleic anhydride copolymer in combination with a bisulfite. Such paper products exhibit release properties. Various amine salts of half esters of maleic anhydride/alpha-olefin copolymers have been disclosed as useful paper sizing or water holdout agents. Similarly, prior art discloses paper products impregnated with a sizing and wet strength agent of a reaction product of an alkyl tertiary amino alcohol and a copolymer of maleic anhydride/styrene or derivatives thereof. The use of an agent consisting of epoxide resins and maleic anhydride copolymers as an agent for imparting wet strength is known.

Polymeric treatment agents for adding wet strength to paper, which can be applied to a slurry or to a paper web, wherein curing times are said to range from 5 minutes to 3 hours, with a desired time range of 10 to 60 minutes, have been disclosed. The application of a polymeric polyacid, a phosphorous containing accelerator, and an active hydrogen compound to a paper web followed by curing at 120° C. to 400° C. for 3 seconds to 15 minutes has also been disclosed.

Accordingly, what is needed is a method of improving the wet performance of cellulosic based webs using non-formaldehyde crosslinking agents.

SUMMARY OF THE INVENTION

The present invention is directed to methods for improving the wet performance of cellulosic webs. The methods impart high wet resiliency, high wet strength, and a high wet/dry strength ratio to wet-formed webs. The methods include applying a polymeric anionic reactive compound (PARC) solution onto a web, with subsequent curing.

In one embodiment of this invention, the PARC is applied heterogeneously to the web, with heterogeneity due to the z-direction distribution of PARC or due to the distribution of the PARC in the plane of the web. Thus, in one embodiment, the PARC may be applied in a particular pattern such as a series of lines or sinusoidal waves extending in a first direction such as the machine direction to provide high wet performance in that first direction by virtue of continuously extending treated zones.

Heterogeneous application of polymeric anionic reactive compound can produce sheets that have regions of high wet strength or high wet resiliency, where polymeric anionic reactive compound has been applied, separated by regions of relatively lower stiffness where polymeric anionic reactive compound has not been applied. Thus, a web can have wet resiliency or wet strength properties and flexibility at levels that cannot readily be obtained in a uniformly treated web.

Heterogeneous application of the PARC to the web can be achieved in several ways, such as by gravure printing, flexographic printing, offset printing, and application through a mask or stencil.

The polymeric anionic reactive compounds useful in the methods are compounds that will cause crosslinking between the cellulose fibers. In one embodiment, the polymeric anionic reactive compounds are made of monomeric units having two carboxylic acid groups on adjacent atoms so that the carboxylic acid groups are capable of forming cyclic anhydrides which, at elevated temperature or other initiating force, will form an ester bond with the hydroxyl groups of the cellulose. Polymers, including copolymers, terpolymers, block copolymers, and homopolymers, of maleic acid are especially desired.

The present invention also is directed to high wet performance webs produced according to the methods of the invention and to articles made with the webs.

Webs are provided which exhibit high wet strength in one direction such as the machine or cross-machine direction, but which readily fail when wet in the orthogonal direction, providing easily flushable webs that nevertheless have good wet strength. The present invention can be used to produce flushable wet wipes, sanitary napkins, dry or pre-moistened bath tissue, and other absorbent products that have good integrity in the machine direction, for example, to resist elongational deformation or, more generally, to resist failure in use. The flushable products, by virtue of having regions that have not been treated with wet strength agents and specifically with polymeric anionic reactive compounds, have regions that can break apart readily when flushed and sent to a septic system, yet still have wet strength zones to enhance use prior to flushing.

DETAILED DESCRIPTION OF THE INVENTION

Definitions

Figure 1:
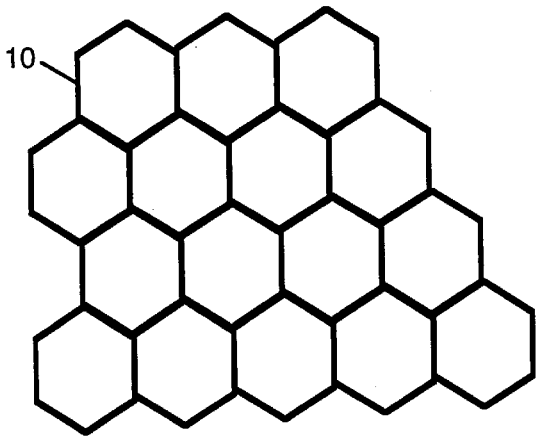
FIG. 1 illustrates a continuous honeycomb network pattern in which the PARC could be applied.

"Papermaking fibers," as used herein, include all known cellulosic fibers or fiber mixes comprising cellulosic fibers. Fibers suitable for making the webs of this invention comprise any natural or synthetic cellulosic fibers including, but not limited to: nonwoody fibers, such as cotton lines and other cotton fibers or cotton derivatives, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers, hardwood fibers, such as eucalyptus, maple, birch, aspen, or the like. Wood fibers may be prepared in high-yield or low-yield forms and include kraft pulps, sulfite pulps, groundwood pulps, thermomechanical pulp (TMP), chemithermomechanical pulp (CTMP), pressure/pressure thermomechanical pulp (PTMP), and bleached chemithermomechanical pulp (BCTMP). High brightness pulps, including chemically bleached pulps, are especially Care is taken not to wet the sample so much that water wicks into the ends of the sample that will make contact with the jaws, otherwise the sample is discarded.—for tissue making, but unbleached or semi-bleached pulps may also be used. Any known pulping and bleaching methods may be used.

Synthetic cellulose fiber types include rayon in all its varieties and other fibers derived from viscose or chemically modified cellulose. Chemically treated natural cellulosic fibers may be used such as mercerized pulps, chemically stiffened or crosslinked fibers, sulfonated fibers, and the like. Suitable papermaking fibers may also include recycled fibers, virgin fibers, or mixes thereof.

As used herein, the term "cellulosic" or "cellulose" is meant to include any material having cellulose as a major constituent, and specifically, comprising at least 50 percent by weight cellulose or a cellulose derivative. Thus, the term includes cotton, typical wood pulps, cellulose acetate, rayon, thermomechanical wood pulp, chemical wood pulp, debonded chemical wood pulp, milkweed floss, and the like.

As used herein, "high yield pulp fibers" are those papermaking fibers produced by pulping processes providing a yield of about 75 percent or greater. Yield is the resulting amount of processed fiber expressed as a percentage of the initial wood mass. High yield fibers are well known for their stiffness (in both dry and wet states) relative to typical chemically pulped fibers. The cell wall of kraft and other low-yield fibers tends to be more flexible because lignin, the "mortar" or "glue" on and in part of the cell wall, has been largely removed. Bleached kraft fibers and other bleached fibers tend to be low-yield, with yields sometimes on the order of 50% or less. Such low-yield fibers have more exposed cellulose area to form bonds with the polymeric reactive compound.

The terms "textile", "web", "tissue", and "towel" are often used herein synonomously.

The present invention is directed to methods for making high wet performance webs. The webs produced by the methods have a high wet strength as compared to webs made according to other methods. The web desirably has a dry tensile strength similar to that of webs made without the addition of the PARC, and a wet tensile strength greater than that of such webs. Accordingly, the wet:dry tensile strength ratio is greater than such webs. Unless otherwise specified, the dry and wet tensile properties of machine-made webs are taken in the machine direction of the web. Desirably, the wet tensile strength index (wet tensile strength normalized for basis weight) is at least about 0.5 Nm/g, more desirably at least about 1 Nm/g, more desirably still at least 1.4 Nm/g, and most desirably from about 0.5 Nm/g to about 1.7 Nm/g, although webs having a higher tensile index could likely be achieved and may be useful for some applications. The wet:dry ratio is desirably at least twice that of the control, and is at least about 20%, desirably at least about 30%, and most desirably at least about 40% or higher.

A high wet performance web of the invention is made by first applying an aqueous solution of a polymeric anionic reactive compound (PARC) to a cellulosic fibrous web. A catalyst can be included in the solution to initiate crosslinking of the PARC to the cellulose. Other ingredients that are commonly included in the preparation of wet performance webs can also be included. The treated and dried web is then cured.

The PARC is applied heterogeneously to the web in either the z-direction or in the plane of the web by one of a number of methods, including printing, spraying, and coating.

I. Compositions

A. Polymeric Anionic Reactive Compounds

Useful polymeric anionic reactive compounds are compounds having repeating units containing two or more anionic functional groups that will covalently bond to hydroxyl groups of the cellulosic fibers. Such compounds will cause inter-fiber crosslinking between individual cellulose fibers. In one embodiment, the functional groups are carboxylic acids, anhydride groups, or the salts thereof.

In a most desired embodiment the repeating units include two carboxylic acid groups on adjacent atoms, particularly adjacent carbon atoms, wherein the carboxylic acid groups are capable of forming cyclic anhydrides and specifically 5member ring anhydrides. This cyclic anhydride, in the presence of a cellulosic hydroxyl group at elevated temperature, forms ester bonds with the hydroxyl groups of the cellulose.

Polymers, including copolymers, terpolymers, block copolymers, and homopolymers, of maleic acid are especially desired, including copolymers of acrylic acid and maleic acid. Polyacrylic acid can be useful for the present invention if a significant portion of the polymer comprises monomers that are joined head to head, rather than head to tail, to ensure that carboxylic acid groups are present on adjacent carbons.

Exemplary polymeric anionic reactive compounds include the ethylene/maleic anhydride copolymers described in U.S. Pat. No. 4,210,489 to Markofsky. Vinyl/maleic anhydride copolymers and copolymers of epichlorohydrin and maleic anhydride or phthalic anhydride are other examples. Copolymers of maleic anhydride with olefins can also be considered, including poly(styrene/maleic anhydride), as disclosed in German Patent No. 2,936,239. Copolymers and terpolymers of maleic anhydride that could be used are disclosed in U.S. Pat. No. 4,242,408 to Evani et al.

Desired polymeric reactive compounds are terpolymers of maleic acid, vinyl acetate, and ethyl acetate known as BELCLENE® DP80 (Durable Press 80) and BELCLENE® DP60 (Durable Press 60), from FMC Corporation.

The polymeric anionic reactive compound desirably has a relatively low molecular weight and thus a low viscosity to permit effective spraying onto a tissue web. The polymeric anionic reactive compound desirably is a copolymer or terpolymer to improve flexibility of the molecule relative to the homopolymer alone. Improved flexibility of the molecule can be manifest by a reduced glass transition temperature as measured by differential scanning calorimetry. Useful polymeric anionic reactive compounds according to the present invention can have a molecular weight less than about 5,000, with an exemplary range of from about 500 to 5,000, more specifically less than about 3,000, more specifically still from about 600 to about 2,500, and most specifically from about 800 to 2000. The polymeric anionic reactive compound BELCLENE® DP80 used in the Examples below is believed to have a molecular weight of from about 800 to about 1000. As used herein, molecular weight refers to number averaged molecular weight determined by gel permeation chromatography (GPC) or an equivalent method.

In aqueous solution, a low molecular weight compound such as BELCLENE® DP80 will generally have a low viscosity, greatly simplifying the processing and application of the compound. In particular, low viscosity is especially desirable for spray application, whether the spray is to be applied uniformly or nonuniformly (e.g., through a template or mask) to the product. A saturated (50% by weight) solution of BELCLENE® DP80, for example, has a room-temperature viscosity of about 9 centipoise, while the viscosity of a solution diluted to 2%, with 1% SHP catalyst, is approximately 1 centipoise (only marginally greater than that of pure water). In general, it is preferred that the polymeric anionic reactive compound to be applied to the paper web have a viscosity at 25° C. of about 50 centipoise or less, specifically about 10 centipoise or less, more specifically about 5 centipoise or less, and most specifically from about 1 centipoise to about 2 centipoise. The solution at the application temperature desirably should exhibit a viscosity less than 10 centipoise and more specifically less than 4 centipoise. When the pure polymeric anionic reactive compound is at a concentration of either 50% by weight in water or as high as can be dissolved in water, whichever is greater, the liquid viscosity desirably is less than 100 centipoise, more specifically about 50 centipoise or less; more specifically still about 15 centipoise or less, and most specifically from about 4 to about 10 centipoise.

As used herein, viscosity is measured with a Sofrasser SA Viscometer (Villemandeur, France) connected to a type MIVI-6001 measurement panel. The viscometer employs a vibrating rod which responds to the viscosity of the surrounding fluid. To make the measurement, a 30 ml glass tube (Corex II No. 8445) supplied with the viscometer is filled with 10.7 ml of fluid and the tube is placed over the vibrating rod to immerse the rod in fluid. A steel guide around the rod receives the glass tube and allows the tube to be completely inserted into the device to allow the liquid depth over the vibrating rod to be reproducible. The tube is held in place for 30 seconds to allow the centipoise reading on the measurement panel to reach a stable value.

Another useful aspect of the polymeric anionic reactive compounds of the present invention is that relatively high pH values can be used when the catalyst is present, making the compound more suitable for neutral and alkaline papermaking processes and more suitable for a variety of processes, machines, and fiber types. In particular, polymeric anionic reactive compound solutions with added catalyst can have a pH above 3, more specifically above 3.5, more specifically still above 3.9, and most specifically of about 4 or greater, with an exemplary range of from 3.5 to 7 or from 4.0 to 6.5.

The polymeric anionic reactive compounds of the present invention can yield wet:dry tensile ratios much higher than traditional wet strength agents, with values reaching ranges as high as from 40% to 85%, for example.

The PARC need not be neutralized prior to treatment of the fibers. In particular, the PARC need not be neutralized with a fixed base. As used herein, a fixed base is a monovalent base that is substantially nonvolatile under the conditions of treatment, such as sodium hydroxide, potassium hydroxide, or sodium carbonate, and t-butylammonium hydroxide. However, it can be desirable to use co-catalysts, including volatile basic compounds such as imidazole or triethyl amine, with sodium hypophosphite or other catalysts.

B. Catalysts

Suitable catalysts include any catalyst that increases the rate of bond formation between the PARC and cellulose fibers. Desired catalysts include alkali metal salts of phosphorous containing acids such as alkali metal hypophosphites, alkali metal phosphites, alkali metal polyphosphonates, alkali metal phosphates, and alkali metal sulfonates. Particularly desired catalysts include alkali metal polyphosphonates such as sodium hexametaphosphate, and alkali metal hypophosphites such as sodium hypophosphite. Several organic compounds are known to function effectively as catalysts as well, including imidazole (IMDZ) and triethyl amine (TEA). Inorganic compounds such as aluminum chloride and organic compounds such as hydroxyethane diphosphoric acid can also promote crosslinking.

Other specific examples of effective catalysts are disodium acid pyrophosphate, tetrasodium pyrophosphate, pentasodium tripolyphosphate, sodium trimetaphosphate, sodium tetrametaphosphate, lithium dihydrogen phosphate, sodium dihydrogen phosphate and potassium dihydrogen phosphate.

When a catalyst is used to promote bond formation, the catalyst is typically present in an amount in the range from about 5 to about 100 weight percent of the PARC. Desirably, the catalyst is present in an amount of about 25 to 75% by weight of the polycarboxylic acid, most desirably about 50% by weight of the PARC.

C. Other Ingredients

A wide variety of other compounds known in the art of papermaking and tissue production can be included in the webs of the present invention. Debonders, for example, such as quaternary ammonium compounds with alkyl or lipid side chains, can be especially useful in providing high wet:dry tensile strength ratios by lowering the dry strength without a correspondingly large decrease in the wet strength. Softening compounds, emollients, silicones, lotions, waxes, and oils can also have similar benefits in reducing dry strength, while providing improved tactile properties such as a soft, lubricious feel. Fillers, fluorescent whitening agents, antimicrobials, ion-exchange compounds, odor-absorbers, dyes, and the like can also be added. Hydrophobic matter added to selected regions of the web, especially the uppermost portions of a textured web, can be valuable in providing improved dry feel in articles intended for absorbency and removal of liquids next to the skin, as disclosed in the commonly owned copending U.S. application Ser. No. 08/997,287, filed Dec. 22, 1997.

The above additives can be added before, during, or after the application of the PARC and/or drying step.

Other chemical treatments of the web can be considered, desirably after curing the PARC, including the inclusion of superabsorbent particles, incorporation of odor-control substances such as cyclodextrins, baking soda, or chelating agents, the topical application of waxes and emollients, and the application of hydrophobic material over portions of the web, including the patterned, topical application of hydrophobic matter to a textured web, as described in commonly owned copending U.S. application, "Dual-zoned Absorbent Webs", Ser. No. 08/997,287, filed Dec. 22, 1997.

A particularly useful aspect of the present invention is the ability to create very high wet:dry tensile ratios by combining treatment with chemical debonding agents with the treatment with a PARC. Desirably, debonder can be added to the web in the furnish or otherwise prior to application of the polymeric anionic reactive compound and subsequent crosslinking. However, debonder may also be added to the web after application of PARC solution and even after crosslinking of the PARC. In another embodiment, the debonder is present in the PARC solution and thus is applied to the web as the same time as the PARC, provided that adverse reactions between the PARC and the debonder are avoided by suitable selection of temperatures, pH values, contact time, and the like.

Debonders such as dialkyl dimethyl quaternary ammonium compounds, imidazoline diquaternary ammonium compounds, and diamidoamine based quaternaries are preferred. However, any debonding agent (or softener) known in the art may be utilized. Examples of useful agents are tertiary amines and derivatives thereof; amine oxides; quaternary amines; silicone-based compounds; saturated and unsaturated fatty acids and fatty acid salts; alkenyl succinic anhydrides; alkenyl succinic acids and corresponding alkenyl succinate salts; sorbitan mono-, di- and tri-esters, including but not limited to stearate, palmitate, oleate, myristate, and behenate sorbitan esters; and particulate debonders such as clay and silicate fillers. Useful debonding agents are described in, for example, U.S. Pat. Nos. 3,395,708, 3,554,862, and 3,554,863 to Hervey et al., U.S. Pat. No. 3,775,220 to Freimark et al., U.S. Pat. No. 3,844,880 to Meisel et al., U.S. Pat. No. 3,916,058 to Vossos et al., U.S. Pat. No. 4,028,172 to Mazzarella et al., U.S. Pat. No. 4,069,159 to Hayek, U.S. Pat. No. 4,144,122 to Emanuelsson et al., U.S. Pat. No. 4,158,594 to Becker et al., U.S. Pat. No. 4,255,294 to Rudy et al., U.S. Pat. No. 4,314,001, U.S. Pat. No. 4,377,543 to Strolibeen et al., U.S. Pat. No. 4,432,833 to Breese et al., U.S. Pat. No. 4,776,965 to Nuesslein et al., and U.S. Pat. No. 4,795,530 to Soerens et al.

Preferred debonding agents for use herein are cationic materials such as quaternary ammonium compounds, imidazolinium compounds, and other such compounds with aliphatic, saturated or unsaturated carbon chains. The carbon chains may be unsubstituted or one or more of the chains may be substituted, e.g. with hydroxyl groups. Non-limiting examples of quaternary ammonium debonding agents useful herein include hexamethonium bromide, tetraethylammonium bromide, lauryl trimethylammonium chloride, and dihydrogenated tallow dimethylammoniurn methyl sulfate. Other preferred debonding agents for use herein to improve fibrous structure flexibility are alkenyl succinic acids, and their corresponding alkenyl succinate salts. Non-limiting examples of alkenyl succinic acid compounds are n-octadecenylsuccinic acid and n-dodecenylsuccinic acid and their corresponding succinate salts. The debonding agent will desirably be added at a level of at least about 0.1%, desirably at least about 0.2%, more desirably at least about 0.3%, on a dry fiber basis. Typically, the debonding agent will be added at a level of from about 0.1 to about 6%, more typically from about 0.2 to about 3%, active matter on dry fiber basis. The percentages given for the amount of debonding agent are given as an amount added to the fibers, not as an amount actually retained by the fibers.

Chemical debonder may be added homogenously or heterogeneously to the web. It can be present in the PARC solution, in which case the debonder will be applied in substantially the same pattern as the PARC solution. The debonder may also be added in a separate step, either uniformly to the web, as is the case when the debonder is present in the furnish or otherwise uniformly applied, or by heterogeneous application to the wet or dry web, either before or after application of the PARC solution to the web. In one embodiment, the PARC solution and the debonder are applied in substantially non-overlapping patterns, or in a matter such that the regions of the web that are substantially or relatively free of PARC solution are the regions which preferentially receive treatment by chemical debonders. For example, the PARC could be applied in a grid-like network defining untreated islands, and the debonder could be applied in a series of unconnected dots registered with the islands defined by the grid treated with PARC, such that the debonded regions do not substantially overlap with the grid lines containing PARC. The inverse system could be used as well. Thus, in general, one fraction of the web in this case would include PARC for good wet strength, while a separate fraction of the web would have debonder for good softness and flexibility.

Similar principles apply to treatment of other additives. The PARC and any other additives can be applied heterogeneously using either a single pattern or a single means of application, or using separate patterns or means of application. Heterogeneous application of the chemical additive can be by gravure printing, spraying, or any method previously discussed for heterogeneous application of PARC solution.

II. Methods of Making the High Wet Performance Webs

The methods include applying a solution of the PARC onto a web with subsequent drying and curing. The PARC solution can be applied through any of a number of methods including coating, printing, and spraying.

A. Preparation of the Web

The fibrous web is generally a random plurality of papermaking fibers that can, optionally, be joined together with a binder. Any papermaking fibers, as previously defined, or mixtures thereof may be used. Bleached fibers from a kraft or sulfite chemical pulping process are especially desired. Recycled fibers can also be used, as can cotton linters or papermaking fibers comprising cotton. Both high-yield and low-yield fibers can be used, though low-yield fibers are generally desired for best results. Because of commercial availability, softwood and hardwood fibers are especially desired. To achieve good softness and opacity, it is desirable that the tissue web comprise substantial amounts of hardwood. For good strength, substantial amounts of softwood are desired. In one embodiment, the fibers may be predominantly hardwood, such as at least 50% hardwood or about 60% hardwood or great or about 80% hardwood or greater or substantially 100% hardwood. Higher hardwood contents are desired for high opacity and softness, whereas higher softwood content is desirable for strength. In another embodiment, the fibers may be predominantly softwood, such as at least 50% softwood or about 60% softwood or greater or about 80% softwood or greater or substantially 100% softwood.

For many tissue applications, high brightness is desired. Thus the papermaking fibers or the resulting paper of the present invention can have an ISO brightness of about 60 percent or greater, more specifically about 80 percent or greater, more specifically about 85 percent or greater, more specifically from about 75 percent to about 90 percent, more specifically from about 80 percent to about 90 percent, and more specifically still from about 83 percent to about 88 percent.

The fibrous web of the present invention may be formed from a single layer or multiple layers. Both strength and softness are often achieved through layered tissues, such as those produced from stratified headboxes wherein at least one layer delivered by the headbox comprises softwood fibers while another layer comprises hardwood or other fiber types. Layered tissue structures produced by any means known in the art are within the scope of the present invention, including those disclosed by Edwards et al. in U.S. Pat. No. 5,494,554. In the case of multiple layers, the layers are generally positioned in a juxtaposed or surface-to-surface relationship and all or a portion of the layers may be bound to adjacent layers. The paper web may also be formed from a plurality of separate paper webs wherein the separate paper webs may be formed from single or multiple layers. In those instances where the paper web includes multiple layers, the entire thickness of the paper web may be subjected to application of the PARC or each individual layer may be separately subjected to application of the PARC and then combined with other layers in a juxtaposed relationship to form the finished paper web.

In one embodiment, the PARC is predominantly applied to one layer in a multilayer web. Alternatively, at least one layer is treated with significantly less polymeric anionic reactive compound than other layers. For example, an inner layer can serve as the wet strength layer.

Suitable paper webs include tissue webs that have been creped or are intended for creping, and wet-pressed or through-dried webs in general, such as those of U.S. Pat. No. 5,637,194 to Ampulski et al., U.S. Pat. No. 4,529,480 to Trokhan, and U.S. Pat. No. 4,440,597 to Wells et al. Other suitable webs include those that are uncreped, such as those of U.S. Pat. No. 5,772,845 to Farrington, Jr. et al.

The web can be formed with normal papermaking techniques, wherein a dilute aqueous fiber slurry is disposed on a moving wire to filter out the fibers and form an embryonic web which is subsequently dewatered by combinations of units including suction boxes, wet presses, through drying units, Yankee dryers, and the like. Examples of known dewatering and other operations are given in U.S. Pat. No. 5,656,132 to Farrington et al.

Dry airlaid webs can also be treated with polymeric anionic reactive compound solution to provide increased stability and wet strength, according to the present invention. Airlaid webs can be formed by any method known in the art, and generally comprise entraining fiberized or comminuted cellulosic fibers in an air stream and depositing the fibers to form a mat. The mat may then be calendered or compressed, before or after treatment with the polymeric anionic reactive compound, using known techniques, including those of U.S. Pat. No. 5,948,507 to Chen et al. Following curing of the polymeric anionic reactive compound, the airlaid web may be used as a wipe, incorporated into an absorbent article such as a diaper, or used in other products known in the art.

Any of the techniques known to those skilled in the papermaking art for drying wet fibrous webs can be used. Typically, the web is dried by applying a heated gas around, over, or through the web, by contacting the web with a heated surface, by applying infrared radiation, by exposure to superheated steam, by microwave or radiofrequency radiation, or by a combination of such methods. Through drying and contact with a heated drum are desired methods of drying. Desirably the web is dried to about 60–100%, more desirably 70–96%, most desirably 80–95% before application of the PARC solution.

The web desirably is substantially free of latex and substantially free of film-forming compounds. Desirably, the applied solution or slurry comprising the polymeric reactive compound is free of latex and its derivatives. The applied solution or slurry also is desirably free of formaldehyde or of cross-linking agents that evolve formaldehyde. Most desirably, the PARC does not comprise formaldehyde nor require formaldehyde for crosslinking.

B. Application of the PARC

The PARC desirably is applied in an aqueous solution to an existing papermaking web. The solution can be applied either as an online step in a continuous papermaking process along a section of a papermaking machine or as an offline or converting step following formation, drying, and reeling of a paper web.

The PARC solution is desirably added at about 10 to 200% add-on, more desirably from about 20% to 100% add-on, most desirably from about 30% to 75% add-on, where add-on is the percent by weight of PARC solution to the dry weight of the web. In other words, 100% add-on is a 1:1 weight ratio of PARC solution to dry web. The final percent by weight PARC to the web is desirably from about 0.1 to 6%, more desirably from about 0.2% to 1.5%. The concentration of the PARC solution can be adjusted to ensure that the desired amount of PARC is added to the web.

The catalyst is present in the PARC solution at an amount in the range from about 5 to about 100 weight percent of the PARC. Desirably, the catalyst is present in an amount of about 25 to 75 percent by weight of the PARC, most desirably about 50% by weight of the PARC.

In one embodiment, the PARC is applied heterogeneously to the web, with heterogeneity due to the z-direction distribution of PARC or due to the distribution of the PARC in the plane of the web. In the former case, the PARC may be selectively applied to one or both surfaces of the web, with a relatively lower concentration of the PARC in the middle of the web or on an untreated surface. In the case of in-plane heterogeneity, the PARC may be applied to the web in a pattern such that some portions of the treated surface or surfaces of the web have little or no PARC, while other portions have an effective quantity capable of significantly increasing wet performance in those portions.

Applying PARC in a stratum of web can allow a web to have overall wet strength while permitting the untreated layer to provide high softness, which can be adversely effected by the crosslinking of fibers caused by PARC treatment. Thus, paper towels, toilet paper, facial tissue, and other tissue products can advantageously exploit the combination of properties obtained by restricting PARC treatment to a single stratum of a web, particularly in multi-ply product wherein the treated stratum can be placed toward the interply region, away from the outer surfaces that may contact the skin. The same principle can be used to add wet strength to an absorbent layer such as the absorbent core of a pantiliner without reducing the perceived softness of the surface of the absorbent core that faces toward the body of the user.

In a related embodiment, a network of treated regions would extend in multiple directions, as would occur by printing the PARC on the web in a fish net pattern or other patterns defining continuous regions of treated web surrounded isolated portions of untreated web. In this manner the web can yield high wet performance for a low total quantity of applied PARC and while offering regions that are free of the increased stiffness or other attributes associated with treated regions.

Figure 2:
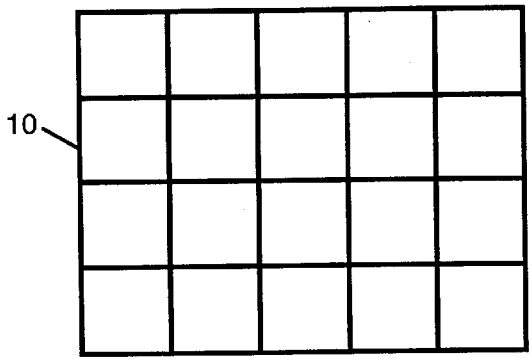
FIG. 2 illustrates a rectilinear grid pattern in which the PARC could be applied.
Figure 3:
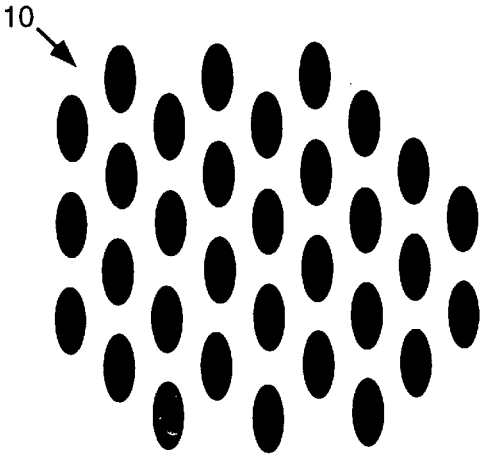
FIG. 3 illustrates a pattern of staggered ovals in which the PARC could be applied.
Figure 4:
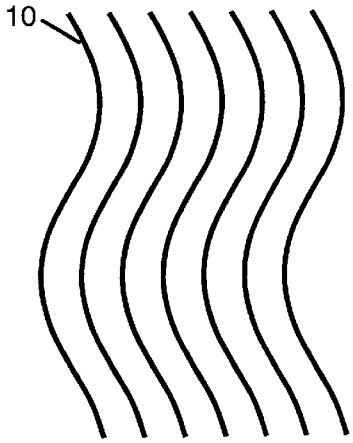
FIG. 4 illustrates a pattern formed by parallel sinusoidal lines in which the PARC could be applied.

FIGS. 1–4 illustrate several of the above-mentioned concepts by depicting examples of patterns 10 for the heterogeneous application of a polymeric anionic reactive compound. FIG. 1 illustrates a continuous honeycomb network. FIG. 2 illustrates a rectilinear grid which, upon rotation, is a simple diamond pattern. FIG. 3 illustrates a pattern formed by staggered ovals. FIG. 4 illustrates a pattern formed by parallel sinusoidal lines. Each pattern 10 in FIGS. 1–4 represents a pattern in which the PARC is applied to a tissue web, but the negative of each pattern could also be used for heterogeneous application of the PARC. For example, when a PARC is applied according to the negative of FIG. 1, the treated regions would be isolated filled hexagons separated by a thin continuous network of untreated regions. Numerous other patterns could be applied, including patterns that are registered with topological features of a textured or embossed web.

A network of PARC-treated regions can be especially useful in wet wipes, where wet strength and flexibility are desirable, with untreated regions generally providing zones of increased flexibility. A network of treated regions can also allow products such as facial tissue, toilet paper, and paper towels to have suitable wet strength with a significant reduction in the amount of chemicals required by providing continuous bands of high wet strength regions interspersed with untreated regions. A network can also provide needed strength to absorbent articles such as pantiliners while maintaining other desired properties such as flexibility or softness.

Figure 5:
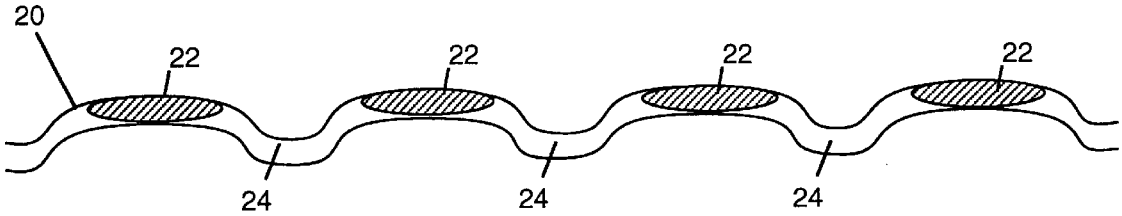
FIG. 5 is a cross-sectional illustration of a web having a patterned application of a PARC.

FIG. 5 depicts a cross-section of textured paper web 20 wherein PARC has been applied heterogeneously to the most elevated portions of the web 22, leaving the depressed regions of the web 24 substantially free of PARC. In this example, the elevated regions 22, having more wet strength and wet resiliency, could be useful in maintaining good strength to resist abrasion, wear, or compressive forces when wet while the untreated regions 24 maintain high flexibility of the web 20, or serve other functions. The textured paper web 20 could be an uncreped, through air dried towel, for example, a section of textured bath tissue, or a wet wipe.

In addition to having an in-line pattern, the PARC in the treated portions may have a nonuniform z-direction distribution, such as being relatively more concentrated on the surface of the web and less concentrated remote from the surface of the web, though the PARC may penetrate throughout the thickness of the web in regions where it is applied. Thus, in one embodiment, the PARC may be applied in a particular pattern such as a series of lines or sinusoidal waves extending in first direction such as the machine direction to provide high wet performance in that first direction by virtue of continuously extending treated zones. The wet performance in a second direction substantially orthogonal to the first direction would be significantly less because no continuous sections of treated paper would extend in the second direction.

Heterogeneous application of a surface of a web with the PARC can be achieved in several ways. Printing technologies are particularly well suited for patterned application, including gravure printing, flexographic printing, offset printing, and the like. Sprays can be applied in selected regions or can be applied through a mask or stencil to permit only selected regions to be treated. Coatings can also be applied to specific bands of the web. And coating, printing, and other application methods can be applied selectively to only one surface of a web for z-direction heterogeneity.

Coating can be achieved with any known coating methods such as blade coaters, metered size presses, wire-round rod coating, and the like. A light coating applied by a metered roll press can be especially useful in applying PARC to only one surface of a web, while printing technologies are especially desired for applying PARC in a network or in another in-plane pattern to the web.

In one embodiment, the PARC solution also includes a coloring agent such as a dye, water-soluble ink, or pigment and the solution is applied heterogeneously to a surface of the paper web to create a pleasing print design or to add optical effects or labeling to the web. The pigment may include titanium dioxide or other solids capable of making a light reflecting or light absorbing slurry that can be printed or more generally heterogeneously applied to a surface of the web to create a pattern such as an image, a label, graphics, or text.

The PARC may be added to any layer independent from other layers in a tissue or paper web, but in one embodiment it is added to the predominantly softwood component of a tissue web to enhance the physical properties of the strength layer. However, excellent results in physical property improvement have also been observed in predominantly hardwood fiber structures (bleached kraft hardwood, for example), particularly a dramatic increase in tensile energy absorbed in the dry state during tensile tests, suggesting that layered tissue production with PARC in predominantly hardwood layers of a tissue could offer improvements in physical properties.

Thus, a useful tissue product can comprise a layer made of at least 50% by weight of hardwood fibers, further comprising from about 0.3% to 2% by weight of PARC, applied either uniformly to the fibers of the layer or applied in a pattern to the layer. One or more remaining layers may comprise softwood fibers or mixtures of softwood and hardwood, or may comprise hardwood fibers substantially free of PARC. Tissue with differing fibers in various strata can be made by supplying different fiber slurries to the strata of a layered headbox, or by joining moist webs together that have been produced using separate headboxes with different fiber slurries C. Drying and Curing the Web Generally, the applied polymeric reactive compound is in a solution that must be dried while on the web and then cured. Drying and curing can be achieved in two separate steps or can be done in one process wherein evaporative water removal is followed by elevating the sheet to a temperature sufficient for curing.

The web, after treatment with the PARC and catalyst solution, can be dried and cured with a variety of methods. Desirably, the web is first dried at a temperature less than 150° C., desirably less than 120° C., more desirably less than 110° C. until the web has a dryness level of desirably about 90% or higher, more desirably about 94% or higher, and most desirably about 98% or higher. Additional energy is then applied to the web to heat the web to a suitable curing temperature. The treated web should be cured at a temperature sufficient to cause the PARC to crosslink with the cellulose fibers.

In one embodiment, this will generally be at a temperature within the range of about 150° C. to 190° C., for a period of time ranging from about 1 minute to 10 minutes, desirably from about 2 to 7 minutes.

In another embodiment, a flash curing technique is employed, wherein the web is exposed to a curing temperature generally above about 160° C., desirably in the range of about 200° C. to 350° C. and most desirably above about 220° C., in the range of about 250–320° C. for a time desirably under about one minute, more desirably less than about 15 seconds, more desirably under about five seconds, even more desirably under about two seconds, and most desirably under about one second.

The time required to properly cure the material will depend upon several factors, including the temperature, the nature of the PARC, the nature and amount of catalyst, and the add-on amount of the PARC.

Suitable drying methods include any known in the art, including contact with a Yankee dryer, contact with other heated drums such as steam-filled cylinders, through air drying, impingement drying, superheated steam drying, infrared drying, and the like. Useful drying methods include through air drying in which a hot gas (preferably air) passes through the web, infrared drying, and drying by conduction from a heated surface such as a Yankee dryer or an internally heated roll having combustion gases, electric elements, or induction heaters to heat the surface of the roll. Through air drying can be accomplished with a non-oxidative gas, but air is preferred for economic reasons. The drying apparatus can also combine both convective heating from hot air and radiative heat transfer, as disclosed in U.S. Pat. No. 4,336,279 to Metzger.

Suitable heating methods for the curing step include contact with heated surfaces such as gas-fired cylinders or other heated drums, infrared heating, radiofrequency heating, microwave heating if suitable dipolar compounds are present in the web to respond to microwave radiation to produce heat, and impingement heating or through-air drying with sufficiently hot air or with other heated gases such as carbon dioxide or nitrogen, which offer the advantage of reduced oxidative damage to the web. The gas should be heated to a temperature sufficient for it to raise the surface of the web to the desired curing temperature.

During many methods of curing, the web should be supported on a porous surface capable of withstanding high temperatures. Open metal wires or other metal supports are especially desired.

Curing of the polymeric reactive compound can also be achieved by radio frequency drying if the polymer comprises abundant dipoles or if other materials are included that respond to radio-frequency radiation. For example, a variety of polymers such as copolyester binder fibers known in the nonwovens industry can be radiofrequency bonded. One example is the amorphous copolyester material CoPET-A which is used in Eastman's KODEL®410 binder fiber, according to W. Haile et al. in the article, "Copolyester Polymer for Binder Fibers," Nonwovens World, April–May 1999, pp. 120–124. This fiber requires a minimum temperature of about 132° C. for good bonding.

The webs produced by the methods have a high wet strength as compared to webs made according to other methods. The web desirably has a dry tensile strength similar to that of webs made without the addition of the PARC, and a wet tensile strength greater than that of such webs. Accordingly, the wet:dry tensile strength ratio is greater than such webs. The increase in wet strength will depend upon the amount of PARC added to the web. Desirably, the wet tensile strength is at least twice that of the untreated web and, for a web having a basis weight of between about 20 to 40, is at least about 100 g/3 inches, more desirably at least about 200 g/3 inches, and even more desirably at least about 300 g/3 inches.

Desirably, the wet tensile index (the wet tensile strength normalized for basis weight) is at least about 0.5 Nm/g, more desirably at least about 1 Nm/g, more desirably still at least about 1.4 Nm/g, and most desirably from about 0.7 Nm/g to about 1.5 Nm/g. The wet:dry ratio is desirably at least twice that of the control, and is at least about 20%, desirably at least about 30%, and most desirably at least about 40% or higher.

III. Methods of Using the High Wet Performance Paper Webs

The treated web may be provided with a number of mechanical, chemical, and physical treatments before or after treatment with the PARC. For example, the web may be creped, apertured, slit, embossed, calendered, converted to a multi-ply web, further treated with softening agents or lotions, printed with graphics, and the like.

Creped or throughdried tissue webs made according to the present invention can be particularly useful as disposable consumer products and industrial or commercial products. Examples include premoistened tissues, paper towels, bath tissue, facial tissue, wet wipes, absorbent pads, intake webs in absorbent articles such as diapers, bed pads, meat and poultry pads, feminine care pads, and the like. Uncreped through-air dried webs having high wet strength and desirably having a basis weight from about 10 grams per square meter (gsm) to about 80 gsm, alternatively from about 20 to about 40 gsm, may be particularly useful as wet resilient, high bulk materials for absorbent articles and other uses, as illustrated by way of example in commonly owned copending U.S. application, Ser. No. 08/614,420, "Wet Resilient Webs and Disposable Articles Made Therewith," by F. J. Chen et al.

The invention is further illustrated by the following examples, which are not to be construed in any way as imposing limitations upon the scope thereof. On the contrary, it is to be clearly understood that resort may be had to various other embodiments, modifications, and equivalents thereof, which, after reading the description herein, may suggest themselves to those skilled in the art without departing from the spirit of the present invention.

EXAMPLE

Test Method

Unless otherwise specified, tensile strengths are measured according to Tappi Test Method T 494 om-88 for tissue, modified in that an MTS SINTECH® 1/G tensile tester (or equivalent) is used having a 3-inch jaw width, a jaw span of 4 inches, and a crosshead speed of 10 inches per minute. Wet strength is measured in the same manner as dry strength except that the tissue sample is folded without creasing about the midline of the sample, held at the ends, and dipped in deionized water for about 0.5 seconds in water to a depth of about 0.5 cm to wet the central portion of the sample, whereupon the wetted region is touched for about 1 second against an absorbent towel to remove excess drops of fluid, and the sample is unfolded and set into the tensile tester jaws and immediately tested. The sample is conditioned under TAPPI conditions (50% RH, 22.7° C.) before testing. Generally 3 samples are combined for wet tensile testing to ensure that the load cell reading is in an accurate range.

Tensile index is a measure of tensile strength normalized for basis weight of the web. Tensile strength can be converted to tensile index by converting tensile strength determined in units of grams of force per 3 inches to units of Newtons per meter and dividing the result by the basis weight in grams per square meter of the tissue, to give the tensile index in Newton-meters per gram (Nm/g).

Example

To demonstrate the use of polymeric anionic reactive compounds applied heterogeneously to a tissue web, a commercially produced uncreped, through-air dried tissue product was obtained, KLEENEX-COTTONELLE® bath tissue produced in 1999. This product features a machine direction "ripple" topography due to molding of the hardwood-softwood blend on a three-dimensional through drying fabric with machine-direction dominant elevated regions. Related patents include U.S. Pat. No. 5,672,248 to Wendt et al. and U.S. Pat. No. 5,429,686 to Chiu et al. The sheets, as perforated, have a length of 4 inches and a width of 4.5 inches, with a conditioned weight of about 0.30 g per sheet. The sheets exhibit a small amount of wet strength due to the presence of PAREZ® strength additive, but still readily break up when wet.

The polymeric anionic reactive compound was a 2% solution by weight of BELCLENE® DP80 combined with 1% by weight of sodium hydrophosphite as a catalyst. The solution was colored by adding 0.3 g of VERSATINT® Purple II liquid dye, a fugitive dye produced by Milliken and Company, Inman, S.C., to 22.4 g of the polymeric anionic reactive compound solution. The resulting purple solution was applied heterogeneously to sheets of the uncreped, through-air dried bath tissue using several methods. In one method, a water color paint brush was used to paint stripes of the polymeric anionic reactive compound solution onto the tissue, with the stripes running either in the machine direction (MD), the cross direction (CD), or crisscrossing diagonally over a sheet to form a diamond-like pattern. The width of the stripes was generally 0.5 inches or less. When dried, the stripes typically occupied about 50% of the surface area of the sheet (the stripes grew somewhat wider than they were when originally painted because of in-plane wicking).

In another method, a paper towel was rolled into a wad and wetted with polymeric anionic reactive compound solution to yield a lower surface having a saturation of nearly 100% which was then lightly stroked over either the top or the back of the bath tissue such that only the highest portions of the bath tissue (MD dominant features) became wetted with the solution and such that the application of the colored solution to the elevated regions was substantially uniform across the width of the sheet. The top surface was the outward surface of the roll as wound, and the back surface was the other side. Based on the visual appearance of the surface-treated samples, about 50% to 70% of the surface area appeared to contain some of the purple dye (after the sheet was dry and some degree of in-plane wicking had occurred).

The treated samples are listed in Table 1. "Add-on" as reported is the weight of liquid added to the web divided by the conditioned weight of the web, multiplied by 100 to convert the ratio to a percentage. After application of the polymeric anionic reactive compound solution, the samples were allowed to air dry at room temperature (overnight for most samples, and for about 2 hours for sample 2G). Several of the samples treated with polymeric anionic reactive compound were then cured at elevated temperature, either 160° C. or 170° C., in a Pro-Tronix® forced-air oven for 3.5 to 4.5 minutes.

TABLE 1

Treated Bath Tissue Samples

| Sample | Add on (%) | Cure Temp (° C.) | Cure Time (minutes) | Treatment |
|---|---|---|---|---|
| 1A | 53 | 160 | 4.5 | 3 MD stripes |
| 1B | 74 | 170 | 3.5 | 6 MD stripes |
| 2A | 15 | uncured | | elevated regions, back |
| 2B | 25 | 170 | 3.5 | elevated regions, back |
| 2C | 32 | 170 | 3.5 | elevated regions, back |
| 2D | 21 | 170 | 3.5 | elevated regions, top |
| 2E | 15 | 170 | 3.5 | elevated regions, top |
| 2F | 22 | 170 | 3.5 | elevated regions, top |
| 2G | 14 | 160 | 4 | 3 MD stripes |

After curing, Sample 2G was saturated with water and stretched by hand to cause failure. The purple treated regions exhibited good wet strength, typical of high-wet strength paper, while the untreated regions between the stripes quickly tore. When CD stress was applied to the wet web, failure occurred in regions between the treated stripes. Other cured samples were tested with an MTS SINTECH® 1/G test device, as described above for tensile testing, but with a gauge length of 2 inches. Results are shown in Table 2 below. All results in Table 2 are for wet MD tensile testing except for the dry tensile testing mean reported therein, which was obtained from 3 untreated samples taken from the same roll used for treated samples. The mean wet properties for the untreated tissue were obtained from 6 samples. Wet:dry tensile ratios were not measured per se but can be roughly approximated by the ratio of treated MD wet tensile to untreated dry MD tensile, since treatment with the PARC does not substantially change the dry strength. TEA is total energy absorbed reported and Stretch is the percent stretch at failure. In samples 2B+2C and 2D+2E+2F, the designated sheets were stacked for the tensile measurements.

TABLE 2

MD Tensile Test Results for Treated and Untreated Samples

| Sample | MD Tensile Strength per sheet (g/3-inch) | MD Tensile Index per sheet (Nm/g) | Stretch (%) | TEA per sheet (g-cm/cm$^2$) | Treated MD Wet Tensile/ Untreated MD Dry Tensile |
|---|---|---|---|---|---|
| 1A | 327.5 | 1.63 | 16.1 | 4.51 | 0.45 |
| 1B | 252.0 | 1.26 | 12.5 | 2.77 | 0.34 |
| 2B + 2C | 176.5 | 0.88 | 13.4 | 2.20 | 0.24 |
| 2D + 2F + 2F | 125.0 | 0.62 | 14.1 | 1.88 | 0.17 |
| Mean Untreated Dry | 731 | — | 12.9 | 8.56 | — |
| Mean Untreated Wet | 85.1 | 0.42 | 15.6 | 1.2 | 0.12 (true MD wet:dry) |

The results show that heterogeneous treatment of tissue can give improved tensile strength when wet when bands of treated material (or a continuous network) exists in the direction of applied strain to carry the load.

In addition, CD tensile testing yielded a wet:dry ratio of 0.097 (9.7%) for the untreated bath tissue. One treated and cured sample with MD stripes was tested for CD wet strength and gave a wet:dry ratio of 0.089 (8.9%), similar to untreated samples, which was not surprising given the lack of continuous treated regions across the gauge length of the testing device to carry the load. Failure in this case occurred, as expected, in the untreated region between two stripes.

The above description is intended to be illustrative and not restrictive. Many embodiments will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated herein by reference.

What is claimed is:

1. A cellulosic paper web comprising from about 0. 1 to 2% by weight of a PARC having a molecular weight from about 500 to about 5,000, from about 0.05% to 2% by weight of a catalyst; wherein the PARC is heterogeneously distributed in the paper web, and wherein the paper web has a wet:dry tensile strength ratio of about 20% or greater.

2. The paper web of claim 1, wherein the PARC is distributed in a repeating pattern on at least one surface of the paper web.

3. The paper web of claim 1, wherein the polymeric anionic reactive compound is predominately present on one surface of the paper web.

4. The paper web of claim 1, further comprising a chemical additive heterogeneously distributed in the web.

5. The paper web of claim 4, wherein the additive is selected from the group consisting of a chemical debonder, a silicone compound, a lotion, a wax, and an oil.

6. The paper web of claim 4, wherein the additive is selected from a superabsorbent material and a cyclodextrin.

7. The paper web of claim 4, wherein the chemical additive is present in a repeating pattern.

8. The paper web of claim 4, wherein the chemical additive is predominately present in regions of the paper web also containing the PARC.

9. The paper web of claim 4, wherein the chemical additive is predominately present in regions of the paper web that are relatively free of the PARC.

10. The paper web of claim 4, wherein the chemical additive is predominately applied to a first surface of the paper web.

11. The paper web of claim 4, wherein the PARC is predominately applied to a second surface of the paper web.

* * * * *

UNITED STATES PATENT AND TRADEMARK OFFICE

CERTIFICATE OF CORRECTION

PATENT NO. : 6,322,665 B1
DATED : November 27, 2001
INVENTOR(S) : Tong Sun et al.

It is certified that error appears in the above-identified patent and that said Letters Patent is hereby corrected as shown below:

Title page,
Item [54], Title, please delete "REACTIVE COMPOUNDS TO FIBROUS WEBS" and insert therefor -- PATTERNED APPLICATION OF POLYMERIC REACTIVE COMPOUNDS TO FIBROUS WEBS --

Signed and Sealed this

Eleventh Day of May, 2004

JON W. DUDAS
*Acting Director of the United States Patent and Trademark Office*